United States Patent [19]

Yanagioka

[11] 4,092,025

[45] May 30, 1978

[54] BASEBALL BAT MADE OF FIBER-REINFORCED PLASTICS

[75] Inventor: Seiichi Yanagioka, Hiratsuka, Japan

[73] Assignee: Aikoh Co., Ltd., Tokyo, Japan

[21] Appl. No.: 688,057

[22] Filed: May 19, 1976

[51] Int. Cl.[2] ..... A63B 59/06

[52] U.S. Cl. ..... 273/72 R

[58] Field of Search ..... 273/67 R, 67 DC, 72 R, 273/72 A, 73 R, 73 C, 73 F, 73 K, 82 R, 82 A; 428/379, 389; 29/191, 197; 427/306, 438; 204/37, 49

[56] References Cited

U.S. PATENT DOCUMENTS

| | | | |
|---|---|---|---|
| 2,195,681 | 4/1940 | Robarge | 273/72 R |
| 3,083,968 | 4/1963 | Takahashi | 273/73 R |
| 3,782,978 | 1/1974 | Souza | 29/197 X |
| 3,830,496 | 8/1974 | Reizer | 273/72 R |
| 4,014,542 | 3/1977 | Tanikawa | 273/72 R |

*Primary Examiner*—Richard J. Apley
*Attorney, Agent, or Firm*—Fay & Sharpe

[57] ABSTRACT

A baseball bat is provided which comprises an elongated body composed of fiber-reinforced plastic material having on the surface thereof a metallic plating of nickel or nickel base alloy.

5 Claims, 1 Drawing Figure

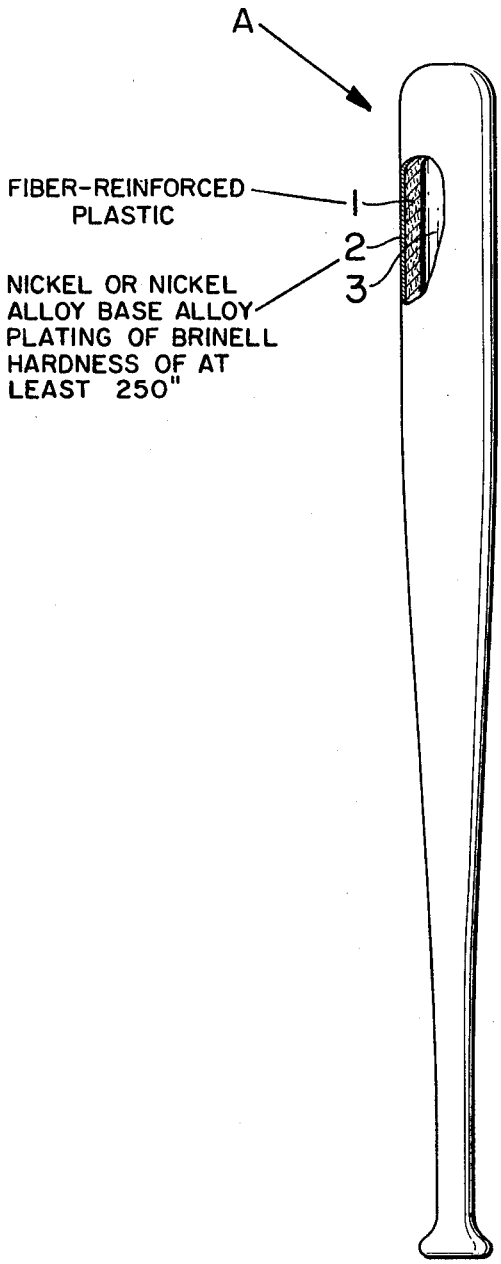
A
FIBER-REINFORCED PLASTIC
1
2
3
NICKEL OR NICKEL ALLOY BASE ALLOY PLATING OF BRINELL HARDNESS OF AT LEAST 250"

BASEBALL BAT MADE OF FIBER-REINFORCED PLASTICS

This invention relates to an improvement of a baseball bat made of fiber-reinforced plastics (hereinafter referred to as FRP).

Being superior in tensile strength and bending strength FRP is used for baseball bat. However, the hardness which is one of the defects of resinous products is small compared with metallic materials. It is therefore likely that the bat is worn subject to friction accompanied by impulsion and that surface scratches of the bat take place by ball tip. This causes much uneveness on the surface due to said scratches and cracks so that the bat is usually disposed of before breaking.

According to the present invention the FRP bat is plated with nickel or nickel base alloy on its surface to offset the defects, so as to make the surface hard and be coated with a viscous coating layer and to decrease the surface scratches caused by batting.

In the plating of nickel base alloy Brinell hardness number for pure nickel is 250 – 500 but that for nickel-phosphorus and nickel-boron alloys is more than 400 to show a higher numerical value and a stronger resistance against coming off than ordinary steels. So long as hardness is concerned plated metals such as chrome, tungsten and rhodium, which are superior to nickel, are lacking in viscosity and inferior to nickel in impulsion. As for other soft metals they have poor wear-resistancy, and it is recognized that nickel or nickel alloy is best for the balance of hardness and viscosity as a metal of coating the surface of baseball bat made of FRP. Further, nickel-phosphorus alloy or nickel-boron alloy is capable of raising hardness by heat treatment so that if heat treatment is effected by determining, according to the kind of FRP, the temperature range which may not have influence upon FRP material, there will be obtained raised hardness fit for temperature.

As regards plating method, similar plated member can be obtained irrespective of electroplating method and electroless plating method, but the electroless plating method is superior for uniform plating on the bat surface.

The FRP materials of the bat having on its surface nickel plating or nickel alloy plating according to the invention, may be selected, as resinous matrix, according to cost and the kind of ball from among thermosetting resins such as phenol resin, epoxy resin, unsaturated polyester resin and methacrylic acid resin and thermoplastic resins such as ABS resin, AS resin, polyoxymethylene resin, nylon, polycarbonate resin, polystyrene resin and polyvinyl chloride resin. Further, the reinforcing materials are made in the form of cotton, twisted yarn, cloth or felt of natural or artificial inorganic fibers such as glass wool, asbestos fiber, rock wool, slag wool, kaolin fiber and carbonaceous fiber; these being sometimes blended, mixed spun, mixed woven or laminated with hemp, cotton, silk, synthetic fiber, artificial cellulosic fiber and paper fiber; finally moulding a baseball bat. That is to say these materials are same as the FRP materials employed for other general purposes.

The invention will now be described further, by way of example only, with reference to the accompanying drawing which shows a schematic sectional view of a baseball bat made of FRP according to this invention.

In the drawing A depicts the baseball bat of the invention and reference numeral 2 is a nickel or nickel alloy plating layer, reference 1 is an FRP material and numeral 3 is a hollow portion.

The FRP moulded to a bat will be plated under the following conditions as an example.

(1) Material:

Unsaturated polyester resin reinforced with glass cloth (2) Plating process:

(i) The resin is first etched with an aqueous solution of anhydrous chromic acid in dilute sulfuric acid and then washed by water.

(ii) Secondly the resin is activated with an aqueous solution of palladium chloride and then washed by water.

(iii) Electroless plating of nickel

Plating melt composition:

Nickel pyrophosphate: 26.7 g/l.

Ortho-boric acid: 1.2 g/l.

Ammonium sulphate: 2.6 g/l.

Sodium acetate: 4.9 g/l.

pH: 5.7 g/l.

Plating temperature: 21° C

Plating time: 20 Hrs.

The following is a plating layer for which an electroless plating was carried out under the above conditions.

Plating thickness: 20μ

Plating layer composition: 6.5% P-Ni alloy

Plating layer hardness:

Just and only adhered: 450 Hv

Heat-treated for drying at 120° C: 600 Hv

What I claim is:

1. A baseball bat comprising an elongated body composed of fiber-reinforced plastic material having on at least part of the surface thereof a metallic plating selected from the group consisting of nickel and nickel base alloys.

2. The baseball bat of claim 1 wherein said metallic plating has a Brinell hardness of at least 250.

3. The baseball bat of claim 1 wherein said metallic plating is nickel.

4. The baseball bat of claim 1 wherein said metallic plating is composed of at least one nickel base alloy selected from the group consisting of nickel-phosphorus and nickel-boron alloys.

5. The baseball bat of claim 1 wherein said elongated body has a hollow interior.

* * * * *